US008763543B2

(12) United States Patent
Bardh

(10) Patent No.: US 8,763,543 B2
(45) Date of Patent: Jul. 1, 2014

(54) MECHANICALLY OPERATED PRESSER FOOT LIFT ARRANGEMENT AND A SEWING MACHINE COMPRISING THE ARRANGEMENT

(75) Inventor: Jonas Bardh, Jönköping (SE)

(73) Assignee: VSM Group AB, Huskvarna (SE)

( * ) Notice: Subject to any disclaimer, the term of this patent is extended or adjusted under 35 U.S.C. 154(b) by 818 days.

(21) Appl. No.: 13/001,402

(22) PCT Filed: Jun. 26, 2008

(86) PCT No.: PCT/SE2008/050782

§ 371 (c)(1),
(2), (4) Date: Mar. 4, 2011

(87) PCT Pub. No.: WO2009/157832

PCT Pub. Date: Dec. 30, 2009

(65) Prior Publication Data

US 2011/0146551 A1 Jun. 23, 2011

(51) Int. Cl.
*D05B 29/02* (2006.01)

(52) U.S. Cl.
USPC ..... 112/237

(58) Field of Classification Search
USPC ..... 112/235, 236, 237, 238, 239, 240
See application file for complete search history.

(56) References Cited

U.S. PATENT DOCUMENTS 2,717,567 A * 9/1955 Hess ..... 112/235
2,836,137 A * 5/1958 Ayres ..... 112/237
3,550,544 A 12/1970 Fairfield et al.
3,570,426 A * 3/1971 Kunes ..... 112/320
3,585,950 A 6/1971 Ito
3,589,320 A 6/1971 Beazley
3,592,153 A 7/1971 Margereson
3,613,608 A 10/1971 Hinerfeld et al.
3,613,610 A 10/1971 Hinerfeld et al.
3,698,334 A 10/1972 Kleinschmidt et al.
3,721,204 A 3/1973 Schaffer et al.
3,727,567 A 4/1973 Beazley
3,763,805 A 10/1973 Weigert
3,799,087 A 3/1974 Beamish et al.

(Continued)

FOREIGN PATENT DOCUMENTS

DE 102007001073 A1 8/2007
EP 39680 A1 11/1981

(Continued)

*Primary Examiner* — Danny Worrell
(74) *Attorney, Agent, or Firm* — Lando & Anastasi, LLP

(57) ABSTRACT

The invention relates to a mechanically operated presser foot lift arrangement (2) comprising a presser bar (14) with a presser foot (15) and a presser foot lift (16) having a body (17) and a handle (18). The body (18) comprises a guiding means (21). An actuating means (23) connected to the presser bar is arranged to be guided along the guiding means on rotation of the body about a shaft (19). The guiding means cooperates with a first locking means (26) for locking the actuating means in a position corresponding to a first lifting height of the presser bar. The arrangement comprises also a displaceable means (27) having a second locking means (28), which may be brought into and out of cooperation with the guiding means. When positioned in cooperation with the guiding means, the second locking means is arranged for locking the actuating means in a position corresponding to a second lifting height of the presser bar.

13 Claims, 8 Drawing Sheets

(56) References Cited

U.S. PATENT DOCUMENTS

| | | | | | |
|---|---|---|---|---|---|
| 3,815,532 | A | * | 6/1974 | Weisz et al. | 112/221 |
| 3,818,849 | A | | 6/1974 | Maddox, Jr. | |
| 3,904,890 | A | | 9/1975 | Wenrich et al. | |
| 3,967,566 | A | | 7/1976 | Spiegel et al. | |
| 4,056,071 | A | * | 11/1977 | Adams | 112/237 |
| 4,098,208 | A | | 7/1978 | Hedegaard | |
| 4,116,145 | A | | 9/1978 | Nicolay | |
| 4,185,575 | A | | 1/1980 | Brown et al. | |
| 4,214,540 | A | | 7/1980 | Cook | |
| 4,246,858 | A | | 1/1981 | Ogawa | |
| 4,323,024 | A | * | 4/1982 | Jones et al. | 112/237 |
| 4,324,191 | A | | 4/1982 | Brown | |
| 4,342,272 | A | * | 8/1982 | Transue et al. | 112/237 |
| 4,373,458 | A | | 2/1983 | Dorosz et al. | |
| 4,412,498 | A | | 11/1983 | Scholl | |
| 4,414,909 | A | | 11/1983 | Bray | |
| 4,426,947 | A | | 1/1984 | Marshall | |
| 4,467,739 | A | | 8/1984 | Hager et al. | |
| 4,479,448 | A | | 10/1984 | Jones et al. | |
| 4,502,400 | A | | 3/1985 | Walther | |
| 4,503,794 | A | * | 3/1985 | Ishihara et al. | 112/313 |
| 4,519,331 | A | | 5/1985 | Kosrow et al. | |
| 4,569,297 | A | | 2/1986 | Dusch | |
| 4,648,337 | A | | 3/1987 | Mall | |
| 4,677,926 | A | | 7/1987 | Dusch et al. | |
| 4,686,917 | A | | 8/1987 | Braun | |
| 4,726,309 | A | | 2/1988 | Popp | |
| 4,803,937 | A | | 2/1989 | Hiramatsu et al. | |
| 4,867,082 | A | | 9/1989 | Sabbioni et al. | |
| 5,138,962 | A | * | 8/1992 | Klundt | 112/311 |
| 5,461,997 | A | | 10/1995 | Landen | |
| 5,481,995 | A | | 1/1996 | Hiratsuka et al. | |
| 6,189,989 | B1 | | 2/2001 | Hirabayashi et al. | |
| 6,736,077 | B2 | | 5/2004 | Pokrishevsky et al. | |
| 7,240,628 | B2 | | 7/2007 | Friman et al. | |
| 7,958,833 | B2 | * | 6/2011 | Fujihara | 112/237 |
| 8,387,547 | B2 | | 3/2013 | Bardh et al. | |
| 2003/0140830 | A1 | | 7/2003 | Pokrishevsky et al. | |
| 2007/0245940 | A1 | | 10/2007 | Wahlstrom | |
| 2009/0114133 | A1 | * | 5/2009 | Fujihara | 112/237 |
| 2011/0094426 | A1 | | 4/2011 | Eklund et al. | |
| 2011/0146551 | A1 | * | 6/2011 | Bardh | 112/237 |
| 2011/0290168 | A1 | * | 12/2011 | Kawai | 112/236 |
| 2012/0017815 | A1 | * | 1/2012 | Fujihara | 112/235 |

FOREIGN PATENT DOCUMENTS

| | | | |
|---|---|---|---|
| EP | 1777331 | A1 | 4/2007 |
| GB | 1179964 | A | 2/1970 |
| GB | 1179965 | A | 2/1970 |
| GB | 1182563 | A | 2/1970 |
| GB | 1200024 | A | 7/1970 |
| GB | 1282153 | A | 7/1972 |
| GB | 1310091 | A | 3/1973 |
| GB | 1315001 | A | 4/1973 |
| GB | 1320765 | A | 6/1973 |
| GB | 1375540 | A | 11/1974 |
| GB | 1393294 | A | 5/1975 |
| GB | 1440350 | A | 6/1976 |
| GB | 2028388 | A | 3/1980 |
| GB | 2043124 | A | 10/1980 |
| GB | 1583629 | A | 1/1981 |
| JP | 6304359 | A | 7/2007 |
| WO | 8101020 | A1 | 4/1981 |
| WO | 8203879 | A1 | 11/1982 |
| WO | 8901067 | A1 | 2/1989 |

* cited by examiner

MECHANICALLY OPERATED PRESSER FOOT LIFT ARRANGEMENT AND A SEWING MACHINE COMPRISING THE ARRANGEMENT

TECHNICAL FIELD

The present invention relates to a mechanically operated presser foot lift arrangement for a sewing machine, which arrangement is to be used for vertical operation of a presser foot. In addition, the present invention relates to a sewing machine comprising the arrangement.

BACKGROUND OF THE INVENTION

A household sewing machine comprises generally a lower arm, a standard and an upper arm, whereby the lower arm is provided with a sewing table at one end. The standard rises from the other end of the lower arm and supports the upper arm, which overhangs the lower arm and terminates in a sewing head. The sewing head is provided with a presser foot lift arrangement comprising a presser bar, which has a presser foot mounted at a lower end. Furthermore, the presser foot lift arrangement comprises a presser foot lift, by means of which the presser bar may be vertically moved so as to vertically move the presser foot in relation to the sewing table.

Today, both mechanically and electrically operated presser foot lift arrangements are known. Most of the known mechanically operated presser foot lift arrangements comprise a presser bar which may be locked at one lifting height only, i.e. at a so-called "normal" lifting height. When the presser bar is locked at the normal lifting height, the presser foot is positioned at such a height that a fabric may be introduced and removed from the stitching instrumentalities. For example, one type of mechanically operated presser foot lift arrangement comprising a presser bar, which may be locked at one lifting height only, is disclosed in US 2007/0204777.

However, a mechanically operated presser foot lift arrangement, which comprises a presser bar that may be locked at two different lifting heights, is also known. More specifically, the known such mechanically operated presser foot lift arrangement comprises a presser bar, which may be locked at the normal lifting height, but also at a so-called "free motion" lifting height. The free motion lifting height is lower than the normal lifting height and is utilized at free-hand sewing, whereby the presser foot tilts up and down against the fabric. This requires a specific type of presser foot.

The known sewing machines being provided with the known mechanically operated presser foot lift arrangement, which comprises a presser bar that may be locked at a normal lifting height and at a free motion lifting height, has the presser lift mounted at a right-hand side of the sewing head. In order to lock the presser bar at the free motion lifting height, the presser bar has to be lifted half-way up to the normal lifting height, where after the presser lift is pushed and folded backwards such that it is engaged with a recess on the outside of the sewing head. Thus, the procedure for locking the presser bar at the free motion lifting height is relatively laborious.

When applying free-hand sewing, a switch between the normal lifting height and the free motion lifting height is required rather frequently. Thereby the user has to perform the laborious process several times, which implies that a lot of time is needed for the switching.

Thus, in accordance with the above mechanically operated presser foot lift arrangements, which comprise a presser bar that may be locked at one or two lifting heights, are known today. However, the known arrangement comprising a presser bar that may be locked at two lifting heights is associated with a relatively laborious locking process. Furthermore, for different reasons it may also be desired or required to be able to lock the presser bar at more than two lifting heights.

Electrically operated presser foot lift arrangements, which comprise a presser bar that may be locked at several lifting heights, are known today. For example, such presser foot lift arrangements are disclosed in U.S. Pat. No. 5,461,997 and U.S. Pat. No. 4,409,914.

However, there is still a need for an improved mechanically operated presser foot lift arrangement comprising a presser bar, which may be locked at two or more different lifting heights and which is not associated with the above mentioned drawbacks.

SUMMARY OF THE INVENTION

Accordingly, one object of the present invention is to provide an improved mechanically operated presser foot lift arrangement for a sewing machine, whereby said arrangement is to be used for vertical operation of a presser foot, said arrangement comprising:

- a vertically movable presser bar,
- a presser foot lift comprising a body and a handle,
- an actuating means operated by means of said presser foot lift for locking said actuating means, utilizing a first locking means, in a first locking position corresponding to a first lifting height of said presser bar.

This object is achieved in that the arrangement further comprises a displaceable means having a second locking means, whereby said second locking means is arranged for locking said actuating means in a second locking position, said second locking position corresponding to a second lifting height of said presser bar.

More in detail, the invention comprises:

- said presser bar axially journalled in a sewing head located at an end of an upper sewing machine arm so as to be vertically moveable, said presser foot being mounted at a lower end of said presser bar;
- the body of said presser foot lift being rotatably arranged about a shaft fixed to said sewing head, whereby said handle is connected to said body such that said body is rotated about said shaft when said handle is operated by a user, said body comprising a guiding means mechanically interacting with said actuating means connected to said presser bar, said actuating means being arranged to be guided along said guiding means on rotation of said body about said shaft, whereby the position of said actuating means along said guiding means determines a lifting height of said presser bar, said guiding means cooperating with said first locking means for locking said actuating means in said first locking position along said guiding means.

An object of the invention is further achieved in that the arrangement further comprises: said displaceable means being displaceable so as to bring said second locking means into and out of cooperation with said guiding means, whereby said second locking means is arranged for locking said actuating means in a second locking position along said guiding means when positioned in cooperation with said guiding means.

Preferred embodiments are listed in the dependent claims.

Still other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures described herein.

BRIEF DESCRIPTION OF THE DRAWINGS

In the drawings, wherein like reference characters denote similar elements throughout the several views.

DETAILED DESCRIPTION OF PREFERRED EMBODIMENTS

The invention will be described in further detail in the following, with reference to the accompanying figures. As mentioned previously, the invention concerns a mechanically operated presser foot lift arrangement for a sewing machine. In particular, the mechanically operated presser foot lift arrangement is intended to be applied in household sewing machines.

As used herein, the expressions "vertical", "horizontal", "top", "lower", "right-hand side", "front", "rear", "forward", "backward" and the like, relate to a sewing machine placed in such a position that it normally has during use for sewing.

Figure 1:
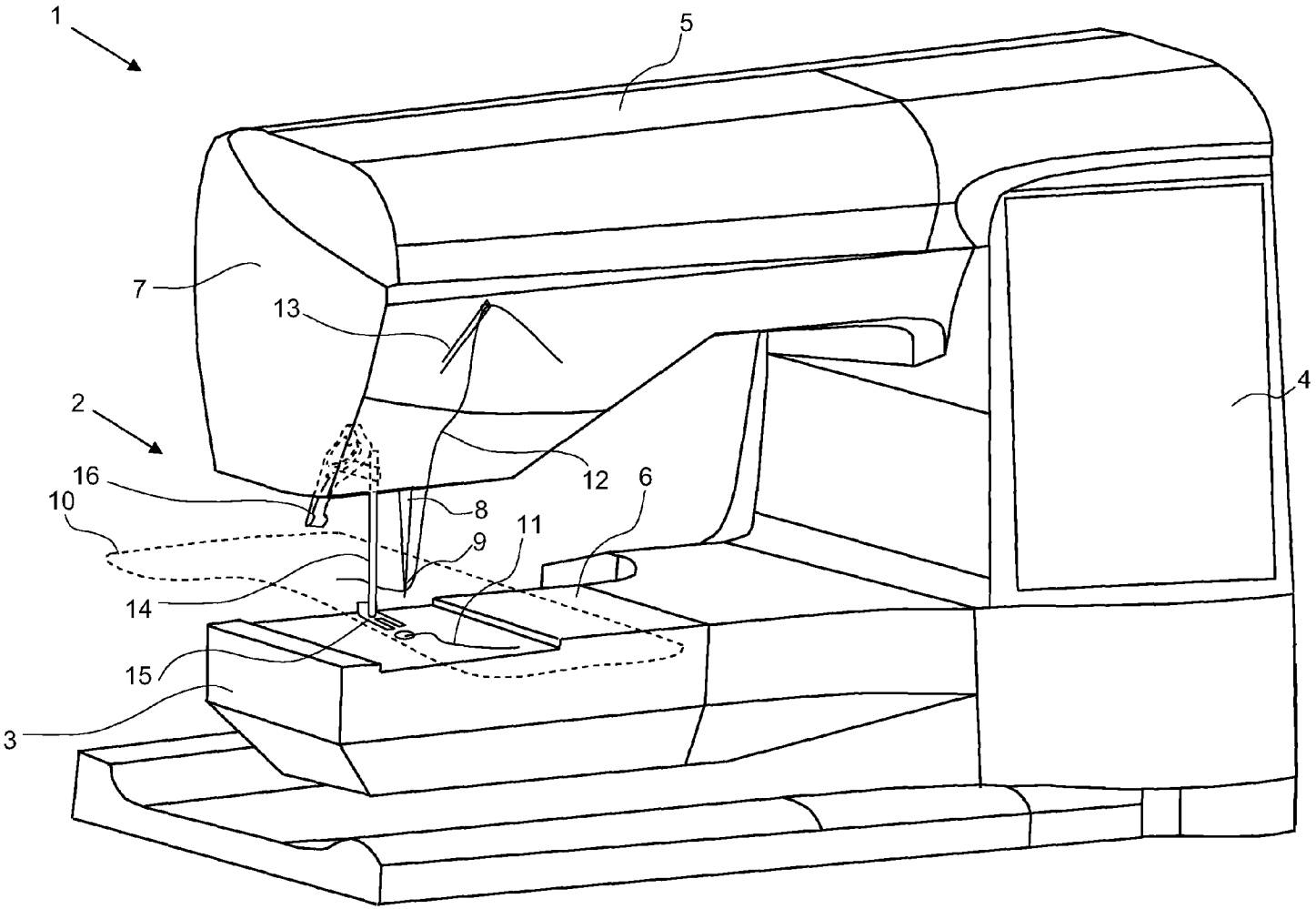
FIG. 1 shows a schematic view of a sewing machine being provided with a mechanically operated presser foot lift arrangement according to the invention.

FIG. 1 shows schematically one example of a household sewing machine 1 comprising a mechanically operated presser foot lift arrangement 2 according to the invention. The sewing machine 1 comprises a lower arm 3, a standard 4 and an upper arm 5. The lower arm 3 is provided with a sewing table 6 at one end and the standard 4 rises from the other end of the lower arm 3. Furthermore, the standard 4 supports the upper arm 5, which overhangs the lower arm 3. The upper arm 5 extends from the standard 4 and terminates in a sewing head 7. The sewing head 7 is provided with a vertically movable needle bar 8, which has a needle 9 mounted at a lower end.

In use of the sewing machine 1, a fabric 10 is fed forward in a conventional manner between a bottom thread 11 and an upper thread 12 in order to execute a desired embroidery comprising stitches effected by means of the needle 9, which moves periodically through the fabric 10. In the illustrated sewing machine 1, the fabric 10 is moved across the sewing table 6 provided on the lower arm 3, which also accommodates a horizontally disposed bottom thread bobbin (not shown) intended for the bottom thread 11 and encased in a gripper (not shown). The upper thread 12 is led via a take-up lever 13, which by a cyclic up and down movement creates a loop of the upper thread 12 when the needle 9, through the eye of which the upper thread 12 runs, has carried the upper thread 12 through the fabric 10 and the take-up lever 13 reverses back upwards from its lowest position. A gripper tip hooks into the loop when the gripper rotates. In order to execute a stitch, the needle 9 performs reciprocating movement so that it leads the upper thread 12 down through the fabric 10, after which the gripper leads the upper thread 12 round the bobbin, which carries the bottom thread 11, resulting in a knot in the fabric 10 when the needle 9 moves up through the fabric 10 and the take-up lever 13 tightens the knot in the fabric 10.

As mentioned above, the sewing machine 1 illustrated in FIG. 1 comprises also a mechanically operated presser foot lift arrangement 2 according to the invention. The arrangement 2 comprises a vertically oriented presser bar 14 having a presser foot 15 mounted at a lower end. In addition, the arrangement 2 comprises a presser foot lift 16. The expression "vertically oriented presser bar" includes herein presser bars which are oriented completely vertically as well as presser bars which are inclined an angle from the vertical direction, i.e. which are essentially vertically oriented or vertically oriented in one plane. The arrangement 2 is to be used for vertical operation of the presser foot 15.

Figure 2A:
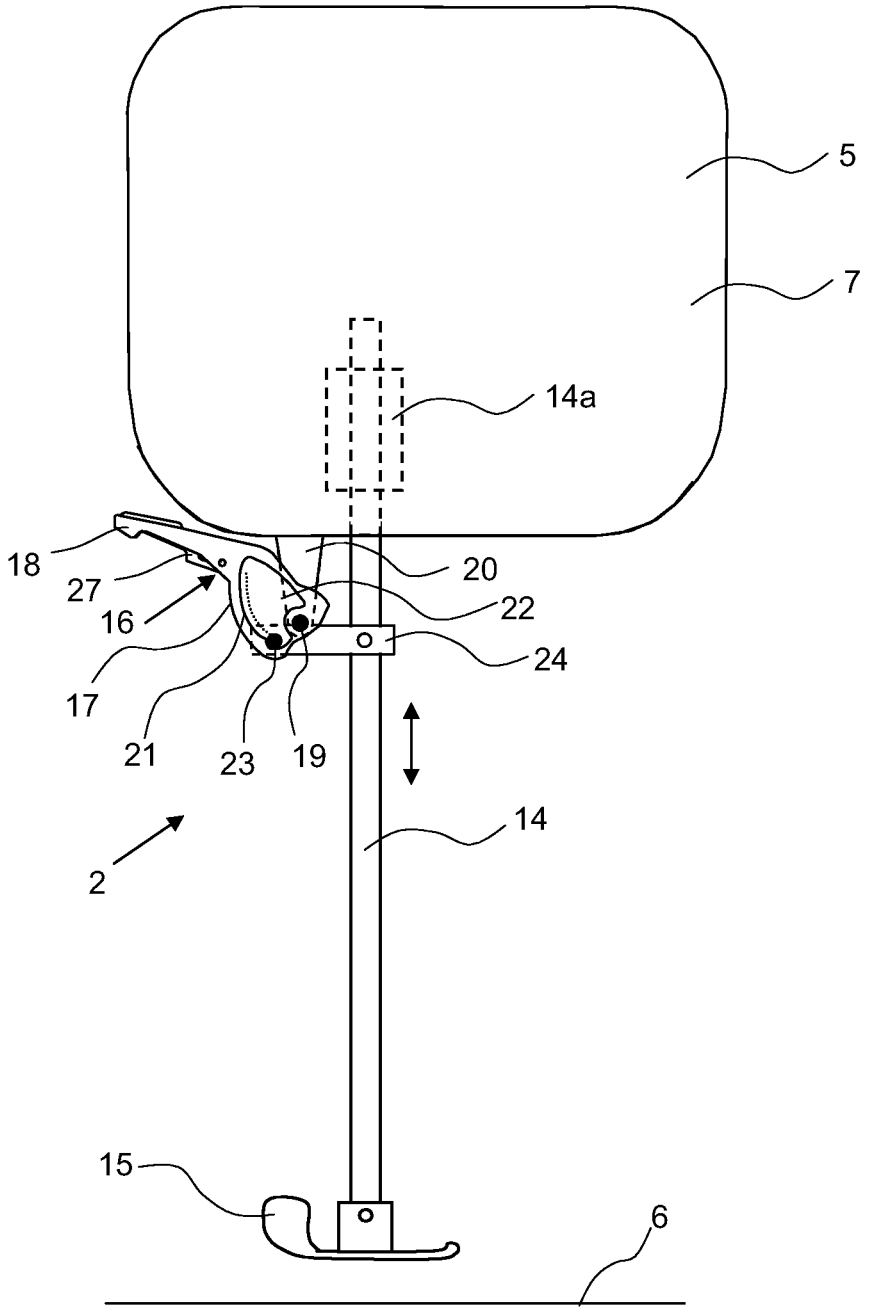
FIG. 2*a* shows a schematic view of a first embodiment of the mechanically operated presser foot lift arrangement according to the invention when the presser bar is locked at a first lifting height.
Figure 2B:
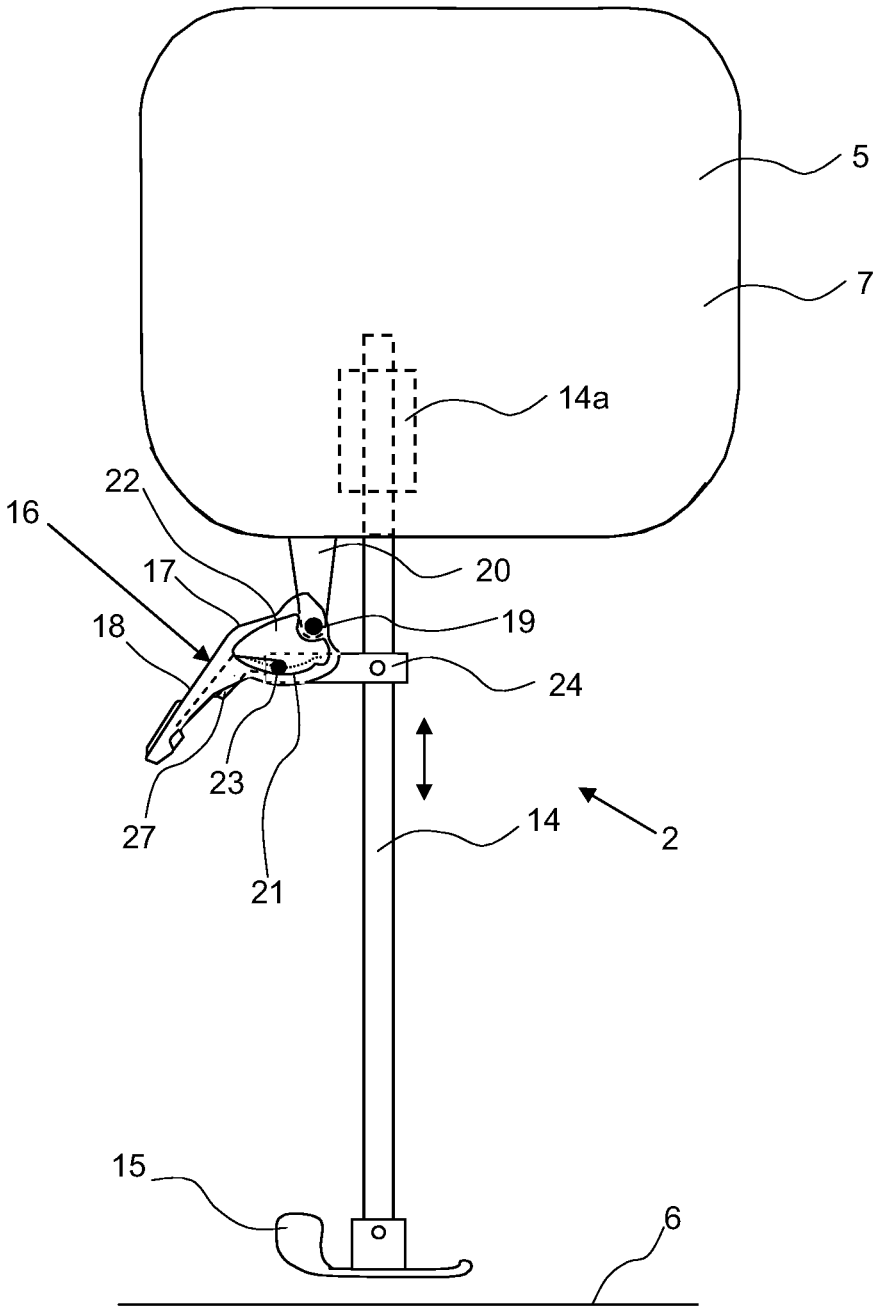
FIG. 2*b* shows a schematic view of the first embodiment of the arrangement according to the invention when the presser bar is locked at a second lifting height.
Figure 2C:
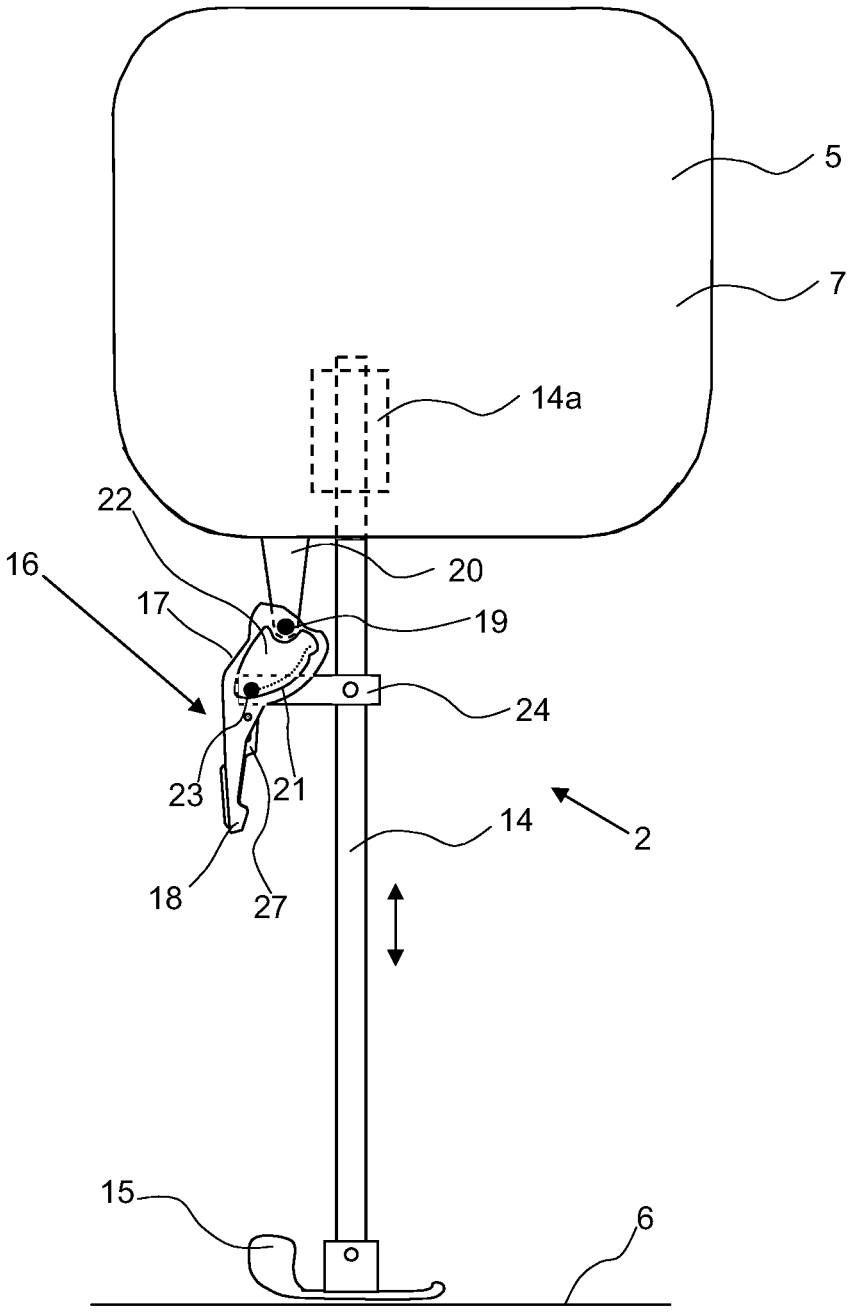
FIG. 2*c* shows a schematic view of the first embodiment of the arrangement according to the invention when the presser bar is positioned at a non-locked position.

The mechanically operated presser foot lift arrangement 2 will now be described in greater detail with reference to FIGS. 2*a-c*, 3*a-b*, 4*a-c*, and 5-6, in which a first embodiment of the arrangement 2 according to the invention or one or more parts thereof is/are illustrated. FIGS. 2*a-c* show schematically a first embodiment of the arrangement 2 according to the invention. As is schematically shown in FIGS. 2*a*-2*c*, the presser bar 14 of the arrangement 2 is axially journalled in the sewing head 7 located at an end of the upper sewing machine arm 5. More specifically, the presser bar 14 is axially journalled, e.g. by means of a sliding bearing or bushing 14*a*, in the sewing head 7 so as to be vertically moveable in relation to the sewing table 6 of the sewing machine 1. The expression "vertically moveable" relates herein to presser bars which are moveable in a completely vertical direction and presser bars which are moveable in an essentially vertical direction, i.e. at an angle in relation to the vertical direction. Furthermore, the presser bar 14 is downwardly biased by, for example, a compression coil spring (not shown). This is well-known in the art and is not further described herein.

The vertical movement of the presser bar 14 is provided by means of the presser foot lift 16 of the arrangement 2. The presser foot lift 16 is shown comprised in the arrangement 2 in FIGS. 2*a-c* and is shown separate from the arrangement in FIGS. 3*a-b*. The presser foot lift 16 comprises a body 17 and a handle 18. The body 17 is rotatably arranged about a shaft 19 fixed to the sewing head 7, i.e. the body 17 may be rotated about the shaft 19 at least to some extent. In FIGS. 2*a-c*, the shaft 19 is shown as extending in the horizontal direction and as extending parallel to the extension of the upper sewing machine arm 5 in the horizontal direction. However, the shaft 19 could extend in any suitable direction. Furthermore, in FIGS. 2*a*-2*c*, the shaft 19 is shown as being fixed to the sewing head 7 by means of a member 20 extending in a vertical direction outside the sewing head 7 from a bottom part thereof. However, the member 20 could alternatively extend in any other direction, e.g. in a horizontal direction, and/or be located at any other suitable position on the sewing head 7. Still alternatively, the shaft 19 could be directly fixed to the sewing head 7 (i.e. without the intermediate member 20).

The handle 18 is connected to the body 17 such that the body 17 is rotated about the shaft 19 when the handle 18 is operated by a user. In the illustrated first embodiment, the body 17 and the handle 18 are integrally formed. However, the body 17 and the handle 18 could likewise be formed as two separate parts, which are connected to each other.

Furthermore, the body 17 comprises a guiding means 21 (i.e. a guide). In the illustrated first embodiment, the guiding means 21 is a curved path formed in the body 17. More specifically, in the illustrated first embodiment, the body 17 comprises a recess 22, whereby parts of the walls of the recess 22 in the body 17 form the curved path 21. Thus, the curved path 21 is constituted by parts of the walls, i.e. borders, of the recess 22 in the body 17.

The curved path 21 is arranged to mechanically interact with an actuating means 23 (i.e. an actuator) connected to the presser bar 14. The actuating means 23 is a means arranged for actuating the vertical position of the presser bar 14 by interacting with the curved path 21. In the illustrated first embodiment, the actuating means 23 is a pin being connected to the presser bar 14. In FIGS. 2*a-c*, the pin 23 is shown as extending in the horizontal direction and as extending parallel to the extension of the upper sewing machine arm 5 in the horizontal direction. However, the pin 23 could extend in any suitable direction. Furthermore, in FIGS. 2*a-c* the pin 23 is shown as being connected to the presser bar 14 via an element 24, which is fixed to the presser bar 14. However, the pin 23 could likewise be directly connected to the presser bar 14 (i.e. without the element 24). Furthermore, the element 24 is shown as extending in a horizontal direction and being connected to the presser bar 14 at a position outside the sewing head 7. However, the element 24 could alternatively extend in any other direction and/or be connected to the presser bar 14 at any other suitable position. For example, the element 24 could be connected to the presser bar 14 inside the sewing head 7. Then the sewing head 7 comprises an opening (not shown), through which the element 24 extends, i.e. the element 24 extends then from the presser bar 14 inside the sewing head 7, through the opening and to the pin 23 located outside the sewing head 7. The mechanical interaction between the curved path 21 and the pin 23 of the first embodiment of the arrangement 2 is shown in more detail in FIGS. 4*a-c*, which are perspective views of the presser foot lift 16 and the pin 23 at three different positions. The different positions will be further described below.

Herein the guiding means 21 is exemplified and illustrated as being a curved path formed by parts of the walls of a recess formed in a body of the presser foot lift and the actuating means 23 is exemplified and illustrated as being a pin connected to the presser bar. However, the guiding means and the actuating means could likewise be embodied in any other way known to a person skilled in the art rendering the same guiding and actuating function, respectively.

The pin 23 is arranged such that parts thereof are positioned in contact with the curved path 21, i.e. in contact with the walls of the recess 22, whereby the pin 23 is arranged to be guided along the curved path 21 on rotation of the body 17 about the shaft 19. Thus, the pin 23 may be moved along the curved path 21 by rotating the body 17 about the shaft 19. Furthermore, the curved path 21 has such a shape and is arranged in such a way in relation to the pin 23 that when the pin 23 is moved along the curved path 21, the presser bar 14 (which is connected to the pin 23) is moved vertically. The position of the pin 23 along the curved path 21 determines a lifting height of the presser bar 14 in relation to the sewing table 6. The fact that the lifting height of the presser bar 14 is determined by the position of the pin 23 along the curved path 21 is schematically shown in FIGS. 2*a-c*. The different lifting heights of the presser bar 14 will be further described below. When the pin 23 is moved along the curved path 21 it follows a lifting curve 25, which is schematically shown by a dotted line in FIGS. 2*a-c* and 3*a-b*.

Figure 3A:
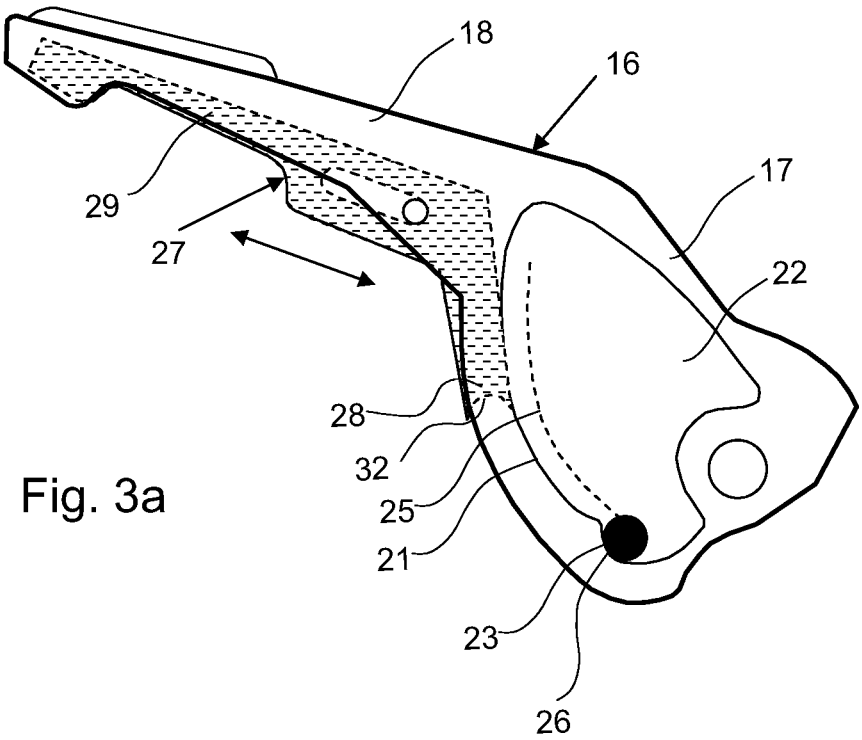
FIG. 3*a* shows a schematic view of the presser foot lift according to FIG. 2*a;*
Figure 4A:
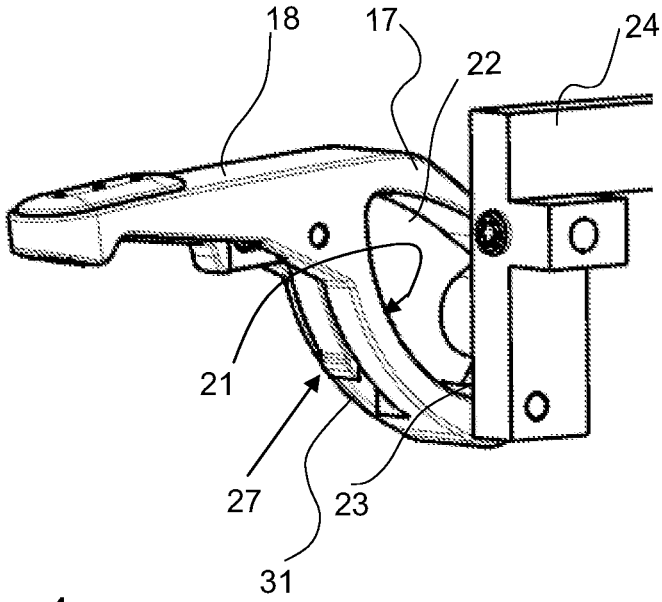
FIG. 4*a* shows a schematic perspective view of the presser foot lift and an actuating means of the arrangement shown in FIG. 2*a* in a position corresponding to the position shown in FIG. 2*a;*

Furthermore, the curved path 21 cooperates with a first locking means 26 (i.e. a first lock device) for locking the pin 23 in a first locking position along the curved path 21. The first locking position corresponds to a first lifting height of the presser bar 14. Thus, when the pin 23 is locked in the first locking means 26, i.e. in the first locking position, the presser bar 14 is locked at a first lifting height. In the illustrated first embodiment, the first locking means 26 is an indentation formed in the curved path 21. However, the first locking means 26 may be any other suitable lock device for locking the pin 23 in a first locking position. FIGS. 2*a*, 3*a* and 4*a* show the pin 23 being locked in the first locking position. In the illustrated first embodiment, the first locking position corresponds to the so-called normal lifting height of the presser bar 14. As mentioned above, when the presser bar 14 is locked at the normal lifting height, the presser foot 15 is positioned at such a height that a fabric may be introduced and removed from the stitching instrumentalities.

In order to position the pin 23 in the first locking means 26, the body 17 is rotated by means of the handle 18 such that the pin 23 is caught by the indentation 26. The indentation 26 has such a shape that the pin 23 is kept in the indentation 26, after having been received by the indentation 26, until the body 17 is further rotated by a user in order to remove the pin 23 from the indentation 26.

Furthermore, the arrangement 2 comprises also a displaceable means 27 having a second locking means 28 (i.e. a second lock device). In the illustrated first embodiment, the displaceable means 27 is a stop lever comprising the second locking means 28 and a lever arm 29. The lever arm 29 is connected to the second locking means 28. In the illustrated first embodiment, the second locking means 28 and the lever arm 29 are integrally formed. However, the second locking means 28 and the lever arm 29 could likewise be formed as two separate parts, which are connected to each other. The stop lever 27 of the first embodiment of the arrangement 2 is separately shown in FIG. 5.

Herein the displaceable means 27 is exemplified and illustrated as being a stop lever. However, the displaceable means could likewise be embodied in any other way known to a person skilled in the art having the same function as the stop lever.

The stop lever 27 is displaceable so as to bring the second locking means 28 into and out of cooperation with the curved path 21. The expression that "the stop lever 27 is displaceable so as to bring the second locking means 28 into and out of cooperation with the curved path 21" is herein intended to denote that the stop lever 27 may be displaced such that the second locking means 28 (or a part thereof) is brought into and out of a position in which it cooperates with the curved path 21 in the guidance of the pin 23 along the curved path 21, i.e. into and out of a position in which it influences the movement of the pin 23 along the curved path 21. The second locking means 28 is arranged for locking the pin 23 in a second locking position along the curved path 21 when positioned in cooperation with the curved path 21.

More specifically, in the illustrated first embodiment, the second locking means 28 of the stop lever 27 comprises a stop face 32. The stop lever 27 of the first embodiment is displaceable so as to bring the stop face 32 of the second locking means 28 into and out of cooperation with the curved path 21, i.e. the stop face 32 may be brought into and out of a position in which it cooperates with the curved path 21 in the guidance of the pin 23 along the curved path 21. Thus, in the illustrated first embodiment, the second locking means 28 is arranged for locking the pin 23 at a second locking position along the curved path 21 when the stop face 32 is positioned in cooperation with the curved path 21. The stop face 32 is then positioned in the recess 22 at a position for catching the pin 23 along the curved path 21.

In FIGS. 2*a*, 2*c*, 3*a*, 4*a* and 4*c*, the stop face 32 is positioned in non-cooperation with the curved path 21. However, in FIGS. 2*b*, 3*b* and 4*b*, the stop face 32 is positioned in cooperation with the curved path 21. Then the stop face 32 is positioned in the recess 22 at a position in which it influences the movement of the pin 23 along the curved path 21, i.e. it is positioned in the recess 22 at a position for catching the pin 23 along the curved path 21. When the pin 23 is caught by the stop face 32, it is locked at a second locking position.

Figure 3B:
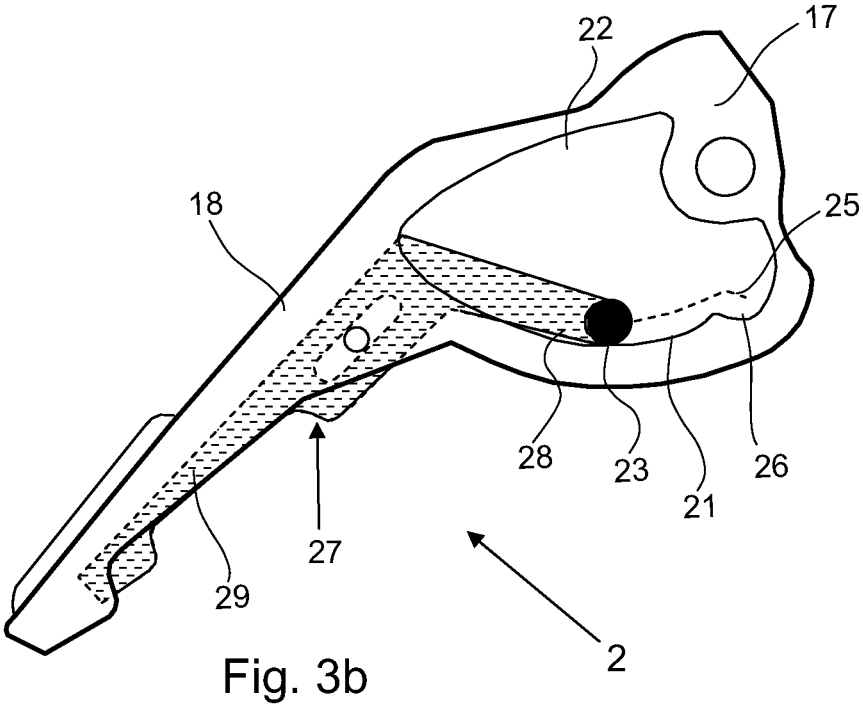
FIG. 3*b* shows a schematic view of the presser foot lift according to FIG. 2*b;*
Figure 4B:
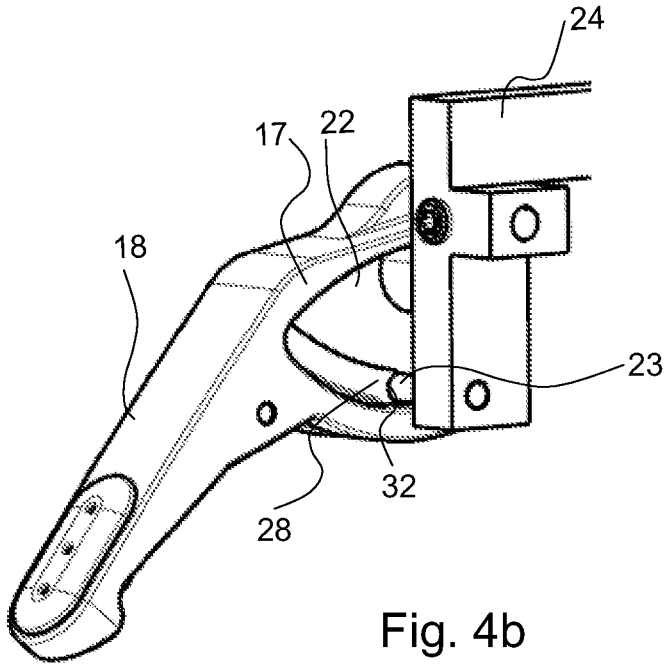
FIG. 4*b* shows a schematic perspective view of the presser foot lift and an actuating means of the arrangement shown in FIG. 2*b* in a position corresponding to the position shown in FIG. 2*b;*

The second locking position corresponds to a second lifting height of the presser bar 14. Thus, when the pin 23 is locked at the stop face 32, i.e. at the second locking position, the presser bar 14 is locked at a second lifting height. FIGS. 2*b*, 3*b* and 4*b* show the pin 23 being locked at the second locking position. In the illustrated first embodiment, the second locking position corresponds to the so-called free motion lifting height of the presser bar 14. However, the second locking position may be adjusted such that it corresponds to any desired lifting height of the presser bar 14. This may be done by adjusting the shape of the second locking means 28 such that the stop face 32 is positioned at a desired position when being positioned along the curved path 21 in cooperation with the curved path 21.

In the illustrated first embodiment, the stop face 32 has the shape of a gap, in which the pin 23 may be received and kept. However, the stop face 32 may have any suitable shape, which permits that the pin 23 is received and kept by the stop face 32. More specifically, the stop face 32 has such a shape that the pin 23 is received and kept there until the stop lever 27 is displaced so as to bring the stop face 32 out of cooperation with the curved path 21 or until the body 17 is rotated in order to lock the pin 23 in the indentation 26.

Preferably, the stop lever 27 is lockable when the stop face 32, and thus the second locking means 28, is positioned in cooperation with the curved path 28. The term "lockable" is herein intended to denote that the stop lever 27 may be locked such that it may not be displaced. For example, the locking may be achieved by means of a snap locking.

In the illustrated first embodiment, the presser foot lift 16 is provided with the stop lever 27. However, the stop lever 27 may alternatively be non-connected to the presser foot lift 16 and arranged in any other suitable way in order to be displaceable so as to bring the stop face 32, and thus the second locking means 28, into and out of cooperation with the curved path 21.

Figure 6:
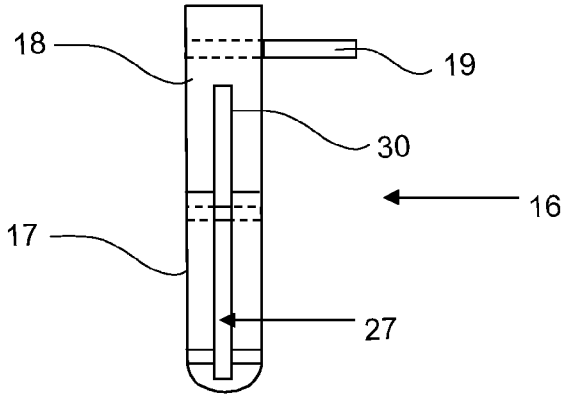
FIG. 6 shows a side view of the presser foot lift shown in FIG. 3*a*.

In the illustrated first embodiment, the lever arm 29 of the stop lever 27 is arranged slidable in relation to the handle 18 of the presser foot lift 16 so as to enable the bringing of the stop face 32, and thus the second locking means 28, into and out of cooperation with the curved path 21. More specifically, the lever arm 29 is arranged slidable in a groove 30 formed in the handle 18 of the presser foot lift 16 (FIG. 6). However, the lever arm 29 may alternatively be arranged in any other suitable way in relation to the handle 18.

Furthermore, in the illustrated first embodiment, the recess 22, which is formed in the body 17, comprises an opening 31 (FIGS. 4*a*-*c*) for bringing the stop face 32, and thus the second locking means 28, into and out of the recess 22 so as to bring the stop face 32, and thus the second locking means 28, into and out of cooperation with the curved path 21. Thus, in the illustrated first embodiment, the stop face 32 may be introduced into and out of the recess 22 through the opening 31. The movement of the stop face 32 into and out of the recess 22 is performed by sliding the stop lever 27 in the groove 30 of the handle 18.

Figure 4C:
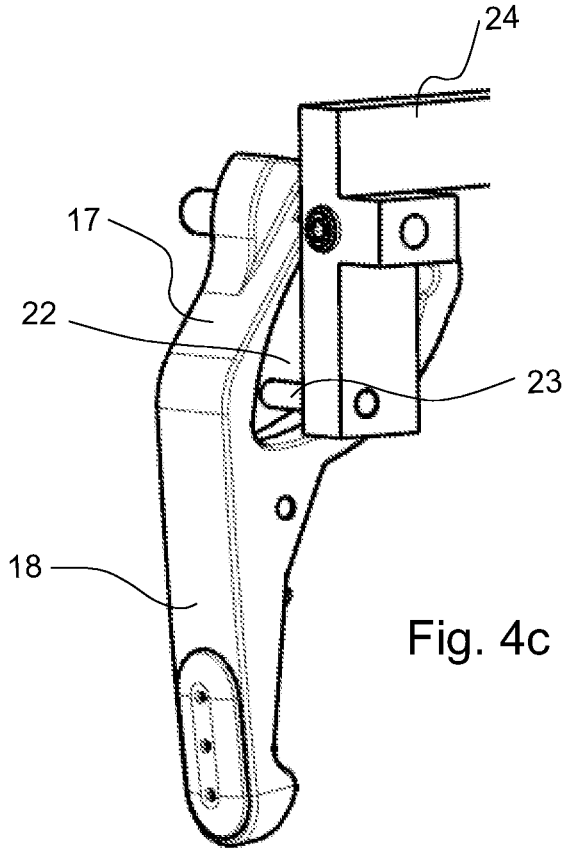
FIG. 4*c* shows a schematic perspective view of the presser foot lift and an actuating means of the arrangement shown in FIG. 2*c* in a position corresponding to the position shown in FIG. 2*c;*
Figure 5:
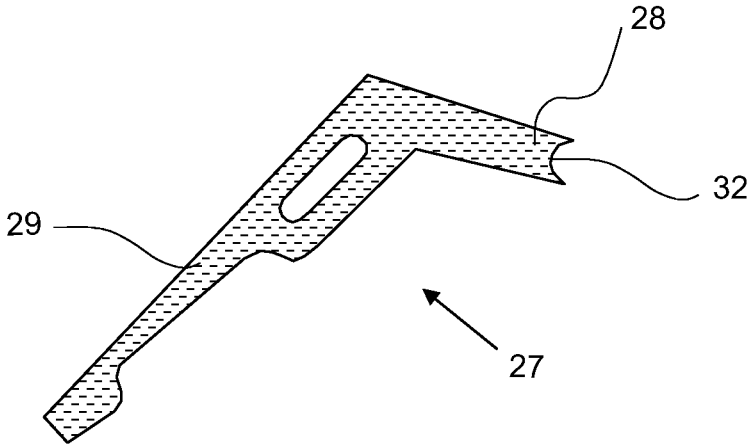
FIG. 5 shows a stop lever of the first embodiment of the arrangement according to the invention.

FIGS. 2*c* and 4*c* show the pin 23 as being positioned at a non-locked position along the curved path 21 corresponding to a vertical position of the presser bar 14 utilized for normal sewing. As mentioned above, the presser bar 14 is downwardly biased by, for example, a compression coil spring. In case the pin 23 is not locked in the indentation 26 (first locking position) and not in the stop face 32 (second locking position), the downward biasing implies that the pin 23 is positioned at the non-locked position. In order to lock the pin 23 at the first or second locking position, the body 17 has to be rotated by means of the handle 18 by a user such that the downward bias is counteracted.

In case the pin 23 is kept at the non-locked position (FIGS. 2*c* and 6*c*) and is to be locked in the second locking position, the body 17 is firstly rotated by means of the handle 18 such that the pin 23 is guided from the non-locked position, along the curved path 21 and past a position for the stop face 32 when it is positioned in cooperation with the curved path 21. Thereafter the stop lever 27 is displaced such that the stop face 32 is brought into cooperation with the curved path 21 and the stop face 32 is allowed to catch the pin 23.

In case the pin 23 is kept in the indentation 26 (FIGS. 2*a* and 6*a*) and is to be locked in the second locking position, the stop lever 27 may firstly be displaced such that the stop face 32 is introduced into the recess 22 through the opening 31 and positioned in the recess 22 at a position for catching the pin 23 along the curved path 21. When the stop face 32 is positioned at this position, the stop face 32 is herein denoted as being positioned in cooperation with the curved path 21 and for locking the pin 23 at a second locking position along the curved path 21. When the stop face 32 is positioned in cooperation with the curved path 21, the second locking means 28 (to which the stop face 32 belongs) is also positioned in cooperation with the curved path 21. Thereafter the body 17 may be rotated by means of the handle 18 such that the pin 23 is removed from the indentation 26 and guided along the curved path 21 until it is caught by the stop face 32 (FIGS. 2*b* and 6*b*).

Alternatively, the stop lever 27 may be displaced such that the stop face 32 is positioned in cooperation with the curved path 21 at the same time as a user operates the handle 17 for rotating the body 18 such that the pin 23 is removed from the indentation 26 and then caught by the stop face 32.

As shown in FIGS. 2*a-c*, the presser foot lift 16 is preferably positioned at a rear part of the sewing head 7 of a sewing machine 1. However, it may be positioned at any suitable position, such as e.g. a right-hand side of the sewing head 7.

Thus, when the illustrated first embodiment of the arrangement 2 is utilized, the presser bar 14 may be locked at a first lifting height, which is achieved when the pin 23 is locked in the indentation 26, and at a second lifting height, which is achieved when the pin 23 is locked at the stop face 32.

Figure 7:
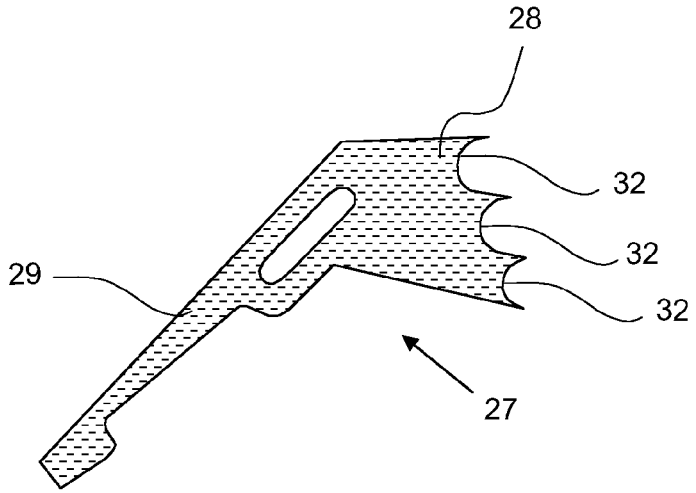
FIG. 7 shows a schematic view of a stop lever of a second embodiment of the arrangement according to the invention.

A second embodiment of the mechanically operated presser foot lift arrangement 2 according to the invention corresponds to the first embodiment except for concerning the second locking means 28 of the stop lever 27. FIG. 7 shows the stop lever 27 of the second embodiment of the arrangement 2. Thus, in the second embodiment, the stop lever 27 shown in FIG. 7 replaces the stop lever 27 shown in FIGS. 2*a-c*, 3*a-b*, 4*a-c* and 5. The second locking means 28 of the stop lever 27 of the second embodiment differs from that of the first embodiment in that the second locking means 28 comprises three stop faces 32 instead of one stop face 32 only. The stop lever 27 of the second embodiment is displaceable so as to bring each stop face 32 into and out of cooperation with the curved path 21. Thus, each stop face 32 may then be brought into a position in the recess 22 in which it cooperates with the curved path 21 in the guidance of the pin 23 along the curved path 21, i.e. into and out of a position in which it influences the movement of the pin 23 along the curved path 21. One stop face 32 is arrangeable in cooperation with the curved path 21 at a time. The second locking means 28 is arranged for locking the pin 23 in a second locking position along the curved path 21 when one stop face 32 is positioned in cooperation with the curved path 21. The different stop faces 32 are associated with locking positions of the pin 23 at different positions along the curved path 21. Thus, each of the three stop faces 32 is associated with a specific lifting height of the presser bar 14.

In the illustrated presser foot lift 16 of the second embodiment of the arrangement 2, each stop face 32 may be introduced into and out of the recess 22 through the opening 31. The movement of the stop faces 32 into and out of the recess 22 is performed by sliding the stop lever 27 in the groove 30 of the handle 18. Preferably, the stop lever 27 is lockable when any of the stop faces 32 is positioned in cooperation with the curved path 21. Thus, the stop lever 27 is preferably lockable when the first stop face 32 is positioned in cooperation with the curved path 21, when the second stop face 32 is positioned in cooperation with the curved path 21 and when the third stop face 32 is positioned in cooperation with the curved path 21, respectively. The term "lockable" is herein intended to denote that the stop lever 27 may be locked such that it may not be displaced in relation to the handle 18 without operation by a user. For example, the locking may be achieved by means of one or more snap lockings.

When the second embodiment of the arrangement 2 is utilized, the pin 23 is lockable in the first locking position by means of the indentation 26 and in a second locking position by means of positioning of one of the stop faces 32 in cooperation with the curved path 21. Thereby, the presser bar 14 may be locked at a first lifting height associated with the first locking position and at a second lifting height associated with the second locking position. The value of the second lifting height associated with the second locking position depends on which of the stop faces 32 that is positioned in cooperation with the curved path 21 and provides the second locking position, since the different stop faces 32 are associated with different lifting heights of the presser bar 14.

The above described second embodiment of the arrangement 2 according to the invention may be varied such that the second locking means 28 of the stop lever 27 comprises a proper other number of stop faces 32 than three. For example, it may comprise two, four, five, six or seven stop faces 32. Then the stop lever 27 is displaceable so as to bring each stop face 32 into and out of cooperation with the curved path 21. Thus, each stop face 32 may then be brought into a position in the recess 22 in which it cooperates with the curved path 21 in the guidance of the pin 23 along the curved path 21, i.e. into and out of a position in which it influences the movement of the pin 23 along the curved path 21. The second locking means 28 is arranged for locking the pin 23 in a second locking position along the curved path 21 when one stop face 32 is positioned in cooperation with the curved path 21. Each stop face 32 is associated with a specific lifting height of the presser bar 14. Thus, in case the second locking means 28 comprises more than one stop face 32, the different stop faces 32 are associated with different lifting heights.

Figure 8:
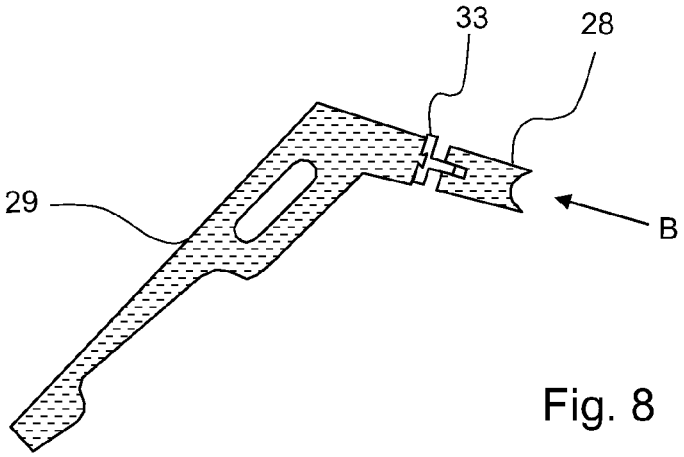
FIG. 8 shows a schematic view of a stop lever of a third embodiment of the arrangement according to the invention.
Figure 8:
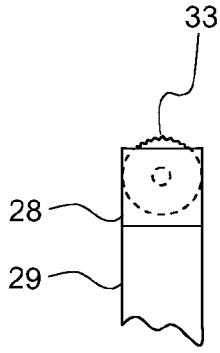

A third embodiment of the mechanically operated presser foot lift arrangement 2 according to the invention corresponds to the first embodiment except for the second locking means 28 of the stop lever 27. FIG. 8 shows the stop lever 27 of the third embodiment of the arrangement 2. The right part of FIG. 8 shows the second locking means as seen in the direction pointed out by arrow B of the left part of FIG. 8. Thus, in the third embodiment, the stop lever 27 shown in FIG. 8 replaces the stop lever 27 shown in FIGS. 2*a-c*, 3*a-b*, 4*a-c* and 5. The second locking means 28 of the stop lever 27 of the third embodiment differs from that of the first embodiment in that the second locking means 28 is adjustably connected to the lever arm 29. According to the third embodiment the length of the second locking means 28 is continuously variable within a predetermined interval. Still according to the illustrated example of the third embodiment said length is variable by means of a setting member, such as a set screw 33, the screw head of which is rotatably arranged about its axial direction at a front end of the lever arm 29. The threaded part of the screw 33 is received by a bore hole arranged in the second locking means 28. Said set screw 33 is mounted a little offset from the centre line of the bodies of the lever arm 29 and the second locking means 28, such that a knurled circumference of the head of said set screw 33 is accessible from the top side of the stop lever 27 inside the previously discussed recess 22. Accordingly, a user can adjust the length of the second locking means 28 by rotating the set screw 33. Such a rotation performed changes the second locking position and thus the specific lifting height of the presser bar 14 within a predetermined interval. Besides, the function of the second locking means 28 is corresponding to that of the first embodiment. An advantage with the third embodiment is that the lifting height of the presser bar 14 is continuously variable within a predetermined interval depending on e.g. the dimensions of the mechanical members involved.

The invention relates also to a sewing machine 1 (FIG. 1) comprising the arrangement 2 according to the invention.

The invention has been described with reference to the embodied figures. However, the invention is not limited to the above-described embodiments alone. Features from one or more of the above embodiments or variants thereof may be combined as required, and the ultimate scope of the invention should be understood as being defined in the appended claims.

The invention claimed is:

1. A mechanically operated presser foot lift system for a sewing machine comprising:

a vertically movable presser bar;

a presser foot lift mechanically coupled to the presser bar, the presser foot lift comprising a handle and a body having a guide path, the guide path comprising a first locking position corresponding to a first presser bar height and a second locking position corresponding to a second presser bar height;

an actuator coupled to the presser bar and in mechanical communication with the guide path;

a first locking device constructed to lock the actuator in the first locking position and hold the presser bar at the first presser bar height;

a stop lever positioned within the presser foot lift body in displaceable communication with the guide path, the stop lever having a second locking device constructed to lock the actuator in the second locking position when in communication with the guide path and hold the presser bar at the second presser bar height.

2. The mechanically operated presser foot system of claim 1, wherein the guide path has a curved shape.

3. The mechanically operated presser foot system of claim 2, wherein the actuator is a pin.

4. The mechanically operated presser foot system of claim 3, wherein a rotation of the presser foot lift causes movement of the pin along the curved guide path.

5. The mechanically operated presser foot system of claim 4, wherein the curved guide path comprises at least one wall of a recess formed in the presser foot lift body.

6. The mechanically operated presser foot system of claim 5, wherein the at least one wall of the recess of the curved guide path allows the stop lever to move into and out of cooperation with the curved guide path.

7. The mechanically operated presser foot system of claim 5 or 6, wherein the first locking device is an indentation along the curved guide path configured to receive the pin.

8. The mechanically operated presser foot system of claim 1, wherein the second locking device comprises a lever arm in communication with a stop face, the stop face constructed to receive the actuator and lock the presser bar at the second presser bar lift height.

9. The mechanically operated presser foot system of claim 8, wherein a distance between the lever arm and stop face is adjustable to regulate the position at which the stop face receives the actuator to adjust the second presser bar lift height.

10. The mechanically operated presser foot system of claim 9, wherein the distance between the lever arm and stop face is adjustable by a screw.

11. The mechanically operated presser foot system of claim 10, wherein the at least one wall of the recess of the curved guide path allows the stop lever to move into and out of cooperation with the curved guide path.

12. The mechanically operated presser foot system of claim 1, wherein the stop lever comprises a lever arm connected to a plurality of stop faces, each of the plurality of stop faces associated with a specific lifting height of the presser bar and configured to receive the actuator and lock the presser bar at the associated presser bar lift height.

13. A sewing machine comprising the mechanically operated presser foot system according to any one claims 1-12.

* * * * *